US009756410B2

(12) United States Patent
Stetson et al.

(10) Patent No.: US 9,756,410 B2
(45) Date of Patent: *Sep. 5, 2017

(54) DIGITAL MICROPHONE INTERFACE SUPPORTING MULTIPLE MICROPHONES

(71) Applicant: Robert Bosch GmbH, Stuttgart (DE)

(72) Inventors: Philip Sean Stetson, Wexford, PA (US); Sucheendran Sridharan, McMurray, PA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/156,101

(22) Filed: May 16, 2016

(65) Prior Publication Data

US 2016/0261939 A1 Sep. 8, 2016

Related U.S. Application Data

(63) Continuation of application No. 13/912,909, filed on Jun. 7, 2013, now Pat. No. 9,344,789.

(51) Int. Cl.
*H04R 1/04* (2006.01)
*H04R 3/00* (2006.01)

(52) U.S. Cl.
CPC ..... *H04R 1/04* (2013.01); *H04R 3/005* (2013.01); *H04R 3/00* (2013.01); *H04R 2201/003* (2013.01)

(58) Field of Classification Search
CPC combination set(s) only.
See application file for complete search history.

(56) References Cited

U.S. PATENT DOCUMENTS 6,064,247 A * 5/2000 Krakirian ..... G06F 1/08 327/115
6,430,606 B1 * 8/2002 Haq ..... H03K 19/018585 709/208
7,929,714 B2 4/2011 Bazarjani et al.
9,344,789 B2 5/2016 Stetson et al.
2008/0285770 A1 * 11/2008 Wu ..... H04R 1/406 381/92
2009/0161428 A1 * 6/2009 Unger ..... G06F 1/3203 365/185.09
2009/0305648 A1 * 12/2009 Ozenne ..... H03D 7/1433 455/78

(Continued)

FOREIGN PATENT DOCUMENTS

WO 2010135825 12/2010

*Primary Examiner* — Duc Nguyen
*Assistant Examiner* — Assad Mohammed
(74) *Attorney, Agent, or Firm* — Michael Best & Friedrich LLP

(57) ABSTRACT

Extending a microphone interface. One microphone interface extension includes a controller, a parent microphone, and a child microphone. The controller outputs a controller clock signal. The parent microphone receives the controller clock signal and generates a first data signal. The child microphone generates a second data signal and outputs the second data signal to the first parent microphone. The parent microphone receives the second data signal from the child microphone and outputs a combined data signal to the controller based on the first data signal and the second data signal. The parent microphone outputs the combined data signal to the controller on a phase of a microphone clock signal derived from the controller clock signal.

13 Claims, 6 Drawing Sheets

(56) References Cited

U.S. PATENT DOCUMENTS

| | | | | |
|---|---|---|---|---|
| 2009/0316731 | A1 | 12/2009 | Kong | |
| 2010/0284525 | A1 | 11/2010 | Saunder et al. | |
| 2012/0052810 | A1 | 3/2012 | Schreuder et al. | |
| 2012/0093334 | A1 | 4/2012 | Schreuder et al. | |
| 2012/0155491 | A1 | 6/2012 | Saunder et al. | |
| 2013/0121504 | A1 | 5/2013 | Adams et al. | |
| 2014/0254837 | A1* | 9/2014 | Mortensen | H03F 3/187 381/120 |

* cited by examiner

DIGITAL MICROPHONE INTERFACE SUPPORTING MULTIPLE MICROPHONES

RELATED APPLICATIONS

This application is a continuation of U.S. application Ser. No. 13/912,909, filed Jun. 7, 2013, the entire content of which is incorporated by reference herein.

FIELD

Embodiments of the invention relate an interface for microphones, such as electrical-mechanical system ("MEMS") microphones. In particular, embodiments of the invention relate to an interface that allows three or more microphones to communicate over a single data bus or line.

BACKGROUND

Existing interfaces for digital microphones support at most two microphones per data line. Therefore, as the number of microphones used in end-systems increases, the number of data lines required increases. Similarly, a device used to encode and decode signals transmitted by the microphones over the data lines (commonly referred to as a "codec") requires an increased number of inputs to handle the increased data lines. Increasing the number of inputs, however, requires silicon changes in the codec and/or a pin-out change for the microphones.

SUMMARY

Accordingly, certain embodiments of the invention provide a digital interface extension for micro electrical-mechanical system ("MEMS") microphone support to allow more than two microphones per single data bus without requiring any additional pins to the encoding or decoding device ("codec"). The digital interface extension employs a parent-child configuration of two or more digital microphones to combine digital data transmitted by each microphone on a signal digital microphone data bus. The microphone configured as the child outputs its data signal to the microphone that is configured as the parent. The parent microphone accepts the data signal from the child microphone and outputs the data from the child microphone on one phase of the controller clock signal and its own data on a different phase of the controller clock signal (e.g., an opposite phase).

One particular embodiment of the invention provides a microphone interface extension that includes a controller (e.g., a codec), a parent microphone, and a child microphone. The controller outputs a controller clock signal. The parent microphone receives the controller clock signal from the controller and generates a first data signal. The child microphone generates a second data signal and outputs the second data signal to the first parent microphone. The parent microphone receives the second data signal from the child microphone and outputs a combined data signal to the controller based on the first data signal and the second data signal. The parent microphone outputs the combined data signal to the controller on a phase of a microphone clock signal derived from the controller clock signal. For example, the parent microphone can output the combined data signal to the controller on one edge of the microphone clock signal (e.g., a rising edge or a falling edge). In some embodiments, the microphone interface extension includes a third microphone that outputs a data signal to the controller codec on a different phase of the microphone clock signal that the parent microphone outputs the combined data signal on. In other embodiments, the microphone interface extension includes a second parent microphone and a second child microphone. The second parent microphone outputs a second combined data signal based on a data signal from the second child microphone to the controller on a different phase of the microphone clock signal than the other parent microphone outputs the first combined data signal on (e.g., an opposite phase).

Another embodiment of the invention provides a method for extending a microphone interface. The method includes receiving, at a first microphone, a controller clock signal from a controller; generating, by the first microphone, a first data signal; and receiving, at the first microphone, a second data signal from a second microphone. The method also includes outputting, by the first microphone a combined data signal to the controller based on the first data signal and the second data signal, wherein the combined data signal is output over a full cycle of the controller clock signal.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium). As such, it should be noted that a plurality of hardware and software based devices, as well as a plurality of different structural components may be utilized to implement the invention.

Figure 1:
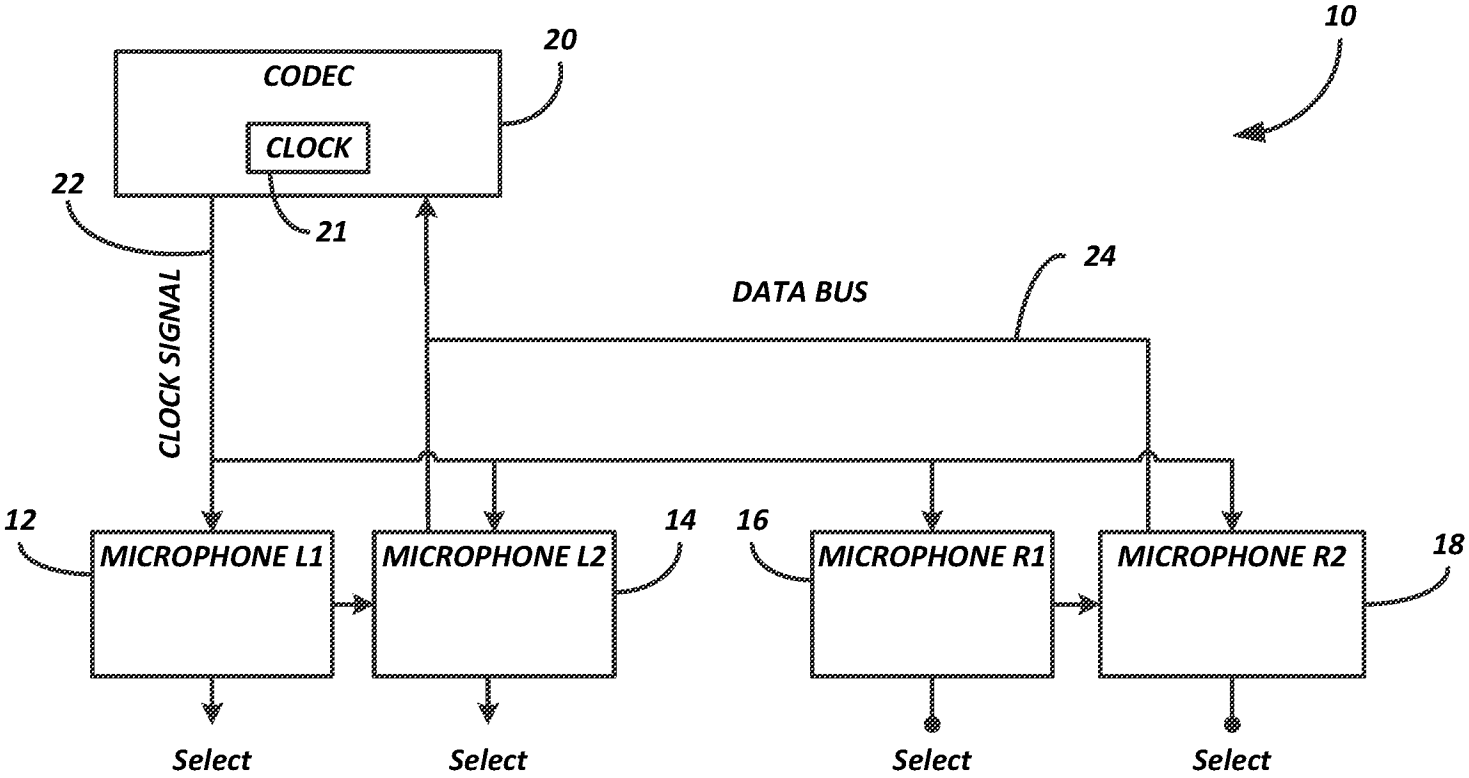
FIG. 1 schematically illustrates a digital interface supporting four microphones.

FIG. 1 schematically illustrates a digital interface 10 for supporting four microphones. The interface 10 includes a first microphone 12, a second microphone 14, a third microphone 16, and a fourth microphone 18. In some embodiments, as illustrated in FIG. 1, the first and second microphones 12 and 14 are configured as left microphones and the third and fourth microphones 16 and 18 are configured as right microphones. All four microphones communicate with a controller. In some embodiments, the controller 20 includes an encoding and decoding device (i.e., a "codec") 20. The codec 20 maintains an internal clock 21 and transmits a controller clock signal to the four microphones based on the clock 21 over a clock signal line 22. The four microphones each derive a microphone clock signal from the controller clock signal received from the codec 20.

Data from the four microphones is transmitted to the codec 20 over a data bus 24. As described in more detail below, the interface 10 uses a parent-child configuration of two digital microphones to combine the digital data from the two microphones onto a single digital microphone data bus. In one implementation, microphones designated as a parent microphone have a different integrated circuit design than microphones designated as a child microphone. However, each microphone integrated circuit is addressed with a signal bit (e.g., over a select pin as illustrated in FIG. 1) that indicates when the microphone outputs data (e.g., whether the microphone outputs data on the falling or rising edge of the microphone clock signal). In some embodiments, microphones designated as a parent microphone include at least one more input than microphones designated as a child microphone to accept data from the child microphone (described below in more detail). For example, a child microphone can include a 5-pin digital microphone, and the parent microphone can include a 6-input microphone.

Figure 2:
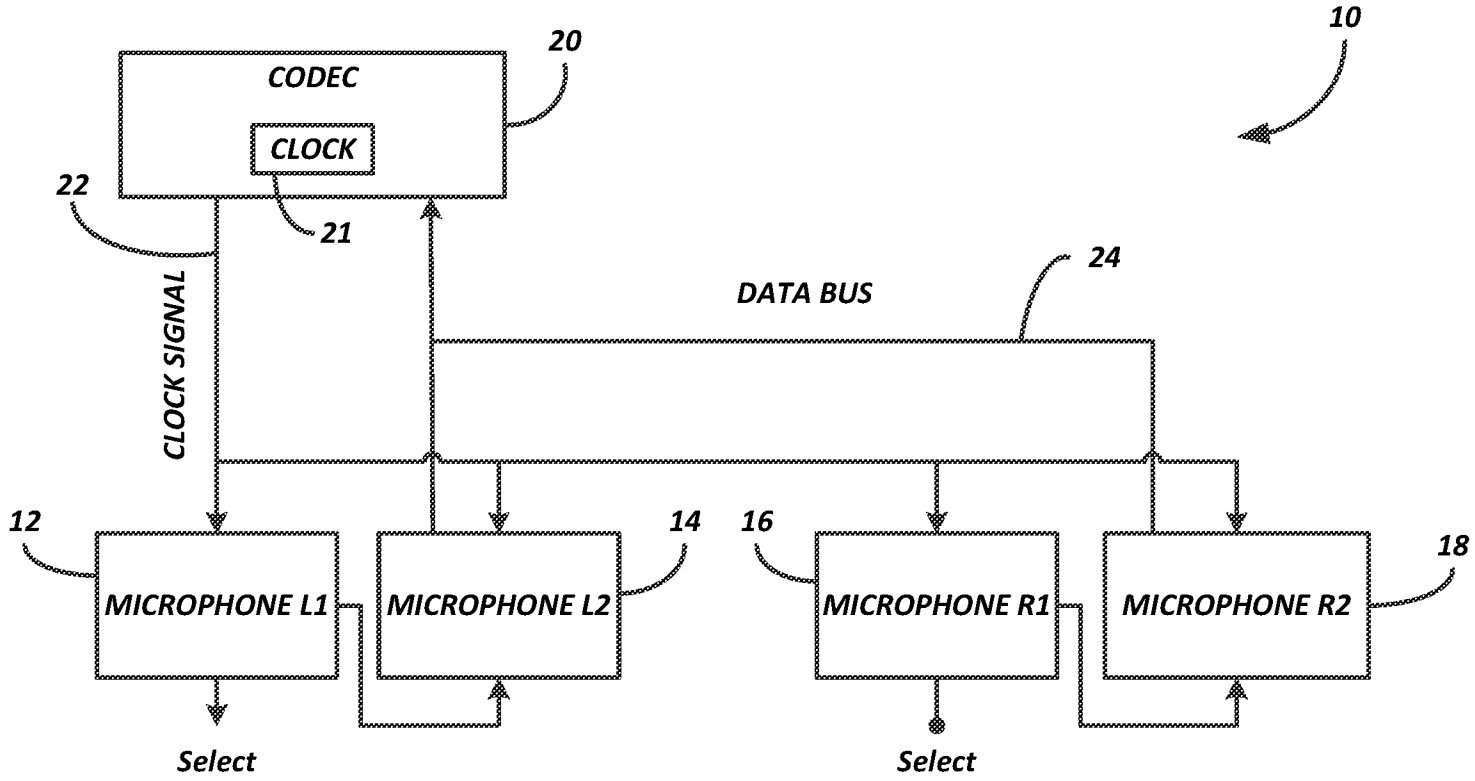
FIG. 2 schematically an alternative digital interface supporting four microphones.

In a different implementation, a microphone can use the select pin to automatically detect whether the microphone is designated as a parent microphone or a child microphone. In particular, as illustrated in FIG. 2, data output from the microphone designated as the child microphone is input to the select pin of the microphone designated as the parent microphone. Accordingly, the select pin of the child microphone will be static and the select pin of the parent microphone will be switching or changing based on data output from the child. Therefore, each microphone is configured to monitor its select pin to detect whether the pin has a static value, which designates the microphone as a child microphone, or is switching or changing, which designates the microphone as a parent microphone. This implementation allows each microphone to include the same integrated circuit design and, in particular, the same standard pin configuration.

Figure 3B:
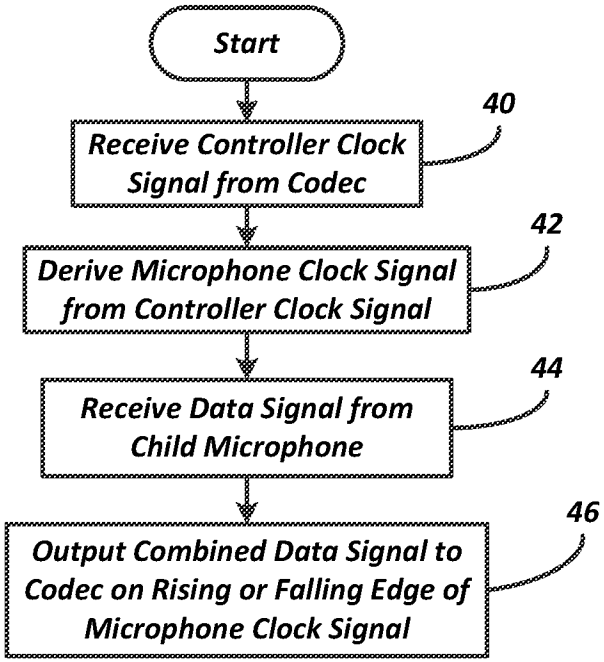
FIG. 3*b* is a flow chart illustrating a method performed by a parent
Figure 3A:
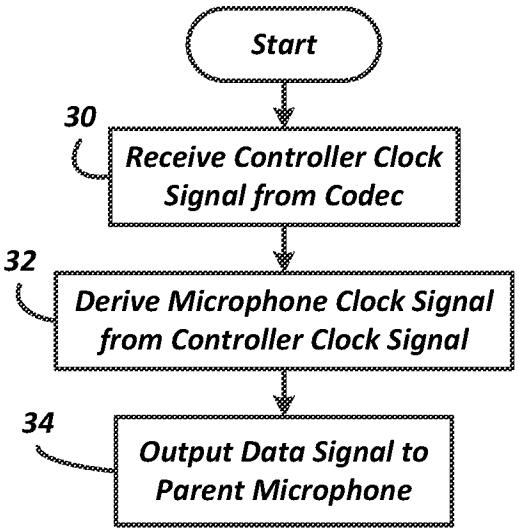
FIG. 3*a* is a flow chart illustrating a method performed by a child microphone.

FIG. 3*a* is a flow chart illustrating a method performed by a child microphone. As illustrated in FIG. 3*a*, a child microphone receives the controller clock signal from the codec 20 (at block 30) and derives a microphone clock signal from the received controller clock signal (at block 32). For example, in some embodiments, the microphone clock signal has half the clock rate of the received controller clock signal. The child microphone uses the microphone clock signal to regulate direct transmission of data signal (i.e., a bitstream) to a parent microphone (at block 34). In some embodiments, the child microphone outputs a data signal to the parent microphone on one phase of the microphone clock signal, such as on a rising or falling edge of the microphone clock signal. It should be understood that in some embodiments, the child microphone does not receive the controller clock signal from the codec 20. In this configuration, the child microphone may receive a clock signal from the parent microphone, may have an internal clock for regulating transmission of data to a parent microphone, or may transmit data to the parent microphone unrelated to a clock signal.

FIG. 3*b* is a flow chart illustrating a method performed by a parent microphone. A parent microphone receives the controller clock signal from the codec 20 (at block 40) and derives a microphone clock signal from the received controller clock signal (at block 42). For example, in some embodiments, the microphone clock signal has half the clock rate of the received controller clock signal. As illustrated in FIG. 3*b*, the parent microphone also receives a data signal from a child microphone (at block 44) (e.g., over a dedicated input pin or over the address select pin as described above with respect to FIGS. 1 and 2). The parent microphone combines the data signal from the child microphone with its own data signal to create a combined data signal. The parent microphone outputs the combined data signal to the codec 20 over the data bus 24 (at block 46). For example, in some embodiments, the parent microphone outputs the combined data signal on the same phase (e.g., the same rising or falling edge) of the microphone clock signal, which corresponds to a full cycle of the controller clock signal. In particular, the parent microphone can output data from the child microphone on one phase of the controller clock signal (e.g., on a rising or a falling edge) and its own data on a different phase of the controller clock signal (e.g., an opposite phase or opposite edge). It should be understood that the clock rates described with respect to the methods of FIGS. 3*a* and 3*b* correspond to the implementation where a parent microphone receives data from a single child microphone. However, as described in more detail below, multiple child microphones can communicate with a parent microphone, and, in these situations, a different clock rate than that described with respect to FIGS. 3*a* and 3*b* is used to coordinate data transmission with the codec 20.

Figure 4:
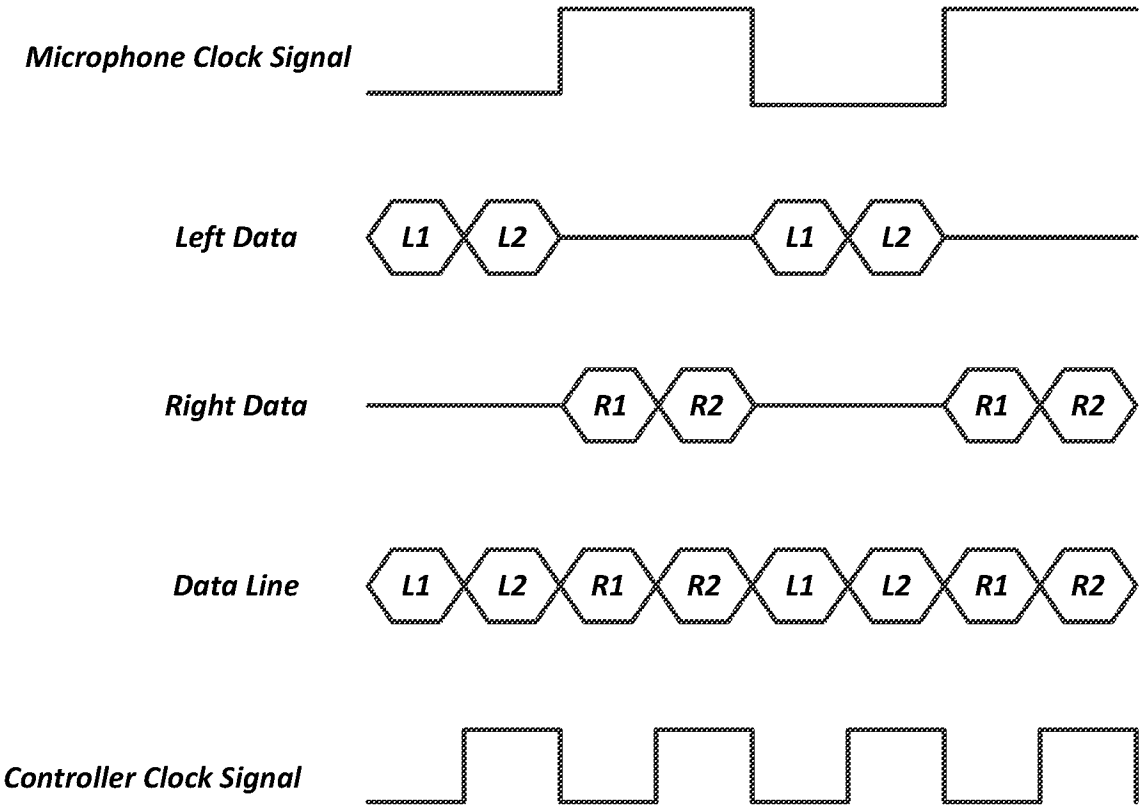
FIG. 4 is a timing diagram illustrating signals generated within the digital interfaces of FIGS. 1 and 2.

FIG. 4 is a timing diagram illustrating signals generated within the digital interfaces of FIGS. 1 and 2. As illustrated in FIG. 4, the microphone clock signal has a clock rate half the rate of the controller clock signal. Accordingly, the codec 20 is configured to output a clock signal to the microphones that is twice the desired data rate. As noted above, each microphone receives the controller clock signal from the codec 20 and derives a microphone clock signal from the controller clock signal, such as by dividing the clock rate of the received controller clock signal in half.

For the first and second microphones 12 and 14 (i.e., the left microphones), the first microphone 12 can be configured as a child microphone and the second microphone 14 can be configured as a parent microphone. Therefore, as illustrated in FIGS. 1 and 2, the first microphone 12 directly transmits a data signal to the second microphone 14 rather than transmitting a data signal to the codec 20. The second microphone 14, as the parent microphone, receives the data from the first microphone 12 and creates a combined data signal for output to the codec 20 that includes data from the first microphone and the second microphone's own data. For example, as illustrated in FIG. 4, the combined signal output by the second microphone 14 includes data from the first microphone 12 (L1) and data from the second microphone 14 (L2). Both pieces of data (i.e., L1 and L2) are output by the second microphone 14 on a phase of the microphone clock signal (e.g., a rising edge or a falling edge). Also, as illustrated in FIG. 4, half of a cycle of the microphone clock signal corresponds to a full cycle or period of the controller clock signal. Therefore, in some embodiments, the second microphone 14 outputs data from the first microphone 12 on one phase (e.g., the rising edge) of the controller clock signal and outputs its own data on an opposite phase (e.g., the falling edge) of the controller clock signal. Whether the second microphone 14 outputs the data on a particular phase (e.g., the rising or falling edge) of the microphone clock signal and/or the controller clock signal can depend on how the second microphone 14 is addressed (e.g., over an address select bit).

Similarly, for the third and fourth microphones 16 and 18 (i.e., the right microphones), the third microphone 16 can be configured as a child microphone and the fourth microphone 18 can be configured as a parent microphone. Therefore, as illustrated in FIGS. 1 and 2, the third microphone 16 directly transmits a data signal to the fourth microphone 18 rather than transmitting a data signal to the codec 20. The fourth microphone 18, as the parent microphone, receives the data from the third microphone 16 and creates a combined data signal for output to the codec 20 that includes data from the third microphone and the fourth microphone's own data. As illustrated in FIG. 4, the combined signal output by the fourth microphone 18 includes data from the third microphone 16 (R1) and data from the fourth microphone 18 (R2). Both pieces of data (i.e., R1 and R2) are output by the fourth microphone 18 on a phase of the microphone clock signal (i.e., a rising edge or a falling edge) opposite the phase that the combined data signal from the second microphone 14 is output on. Also, as illustrated in FIG. 4, half of a cycle of the microphone clock signal corresponds to a full cycle or period of the controller clock signal. Therefore, as described above for the second microphone, in some embodiments, the fourth microphone 14 outputs data from the third microphone 16 on a one phase (e.g., a rising or falling edge) of the controller clock signal and outputs its own data on the opposite phase. Whether the fourth microphone 18 outputs data on a particular phase (e.g., the rising or the falling edge) of the microphone clock signal and/or the controller clock signal can depend on how the fourth microphone 18 is addressed (e.g., over an address select bit).

Accordingly, the interface 10 allows the codec 20 to support and receive data from four microphones over the same data bus 24 without requiring any additional pins to the codec 20. In particular, by using the parent-child configuration, digital data transmitted by two microphones can be combined before being transmitted to the codec 20. In some embodiments, the codec 20 maintains both the controller clock signal and the microphone clock signal and uses the status of both signals to decode data received over the data bus 24. For example, there are four combinations of values between the two signals: (1) microphone signal falling ("0") and controller signal falling ("0"); (2) microphone signal falling ("0") and controller signal rising ("1"); (3) microphone signal rising ("1") and controller signal falling ("0"); and (4) microphone signal rising (1") and controller signal rising ("1"). Accordingly, the codec 20 can use a table, such as Table 1 illustrated below, to map data received over the bus 24 to a particular data source:

TABLE 1

| Microphone Signal | Controller Signal | Data Source |
|---|---|---|
| 0 | 0 | L1 |
| 0 | 1 | L2 |
| 1 | 0 | R1 |
| 1 | 1 | R2 |

It should be understood that the parent-configuration can be used with more than just four microphones as illustrated in FIGS. 1 and 2. In particular, the parent-child configuration can be used to support up to $2^N$ left microphones and up to $2^N$ additional rights microphones. For example, when N is set to zero, the interface 10 includes one left microphone and one right microphone and, consequently, no parent-child configuration is necessary. However, when N is set to one, the interface 10 includes two left microphones and two right microphones as illustrated in FIGS. 1 and 2. Furthermore, when N is set to two, the interface 10 includes four left microphones and four right microphones. In each configuration, the codec clock 21 can be set to $2^N$ times faster than the desired data rate, and the individual microphones can be configured to set their internal clocks 26 based on the codec clock rate divided by $2^N$.

Accordingly, when there is more than two left microphones, one of the left microphones is designated as the parent microphone, and the remaining left microphones are designated as child microphones that transmit their data to the parent microphone for transmission to the codec 20. Similarly, when there is more than two right microphones, one of the right microphones is designated as the parent microphone, and the remaining right microphones are designated as child microphones that transmit their data to the parent microphone for transmission to the codec 20. For multiplexing data between a parent microphone and multiple child microphones, the parent microphone can accept data from multiple child microphones through multiple pins or data can be multiplexed through a single pin.

Figure 5:
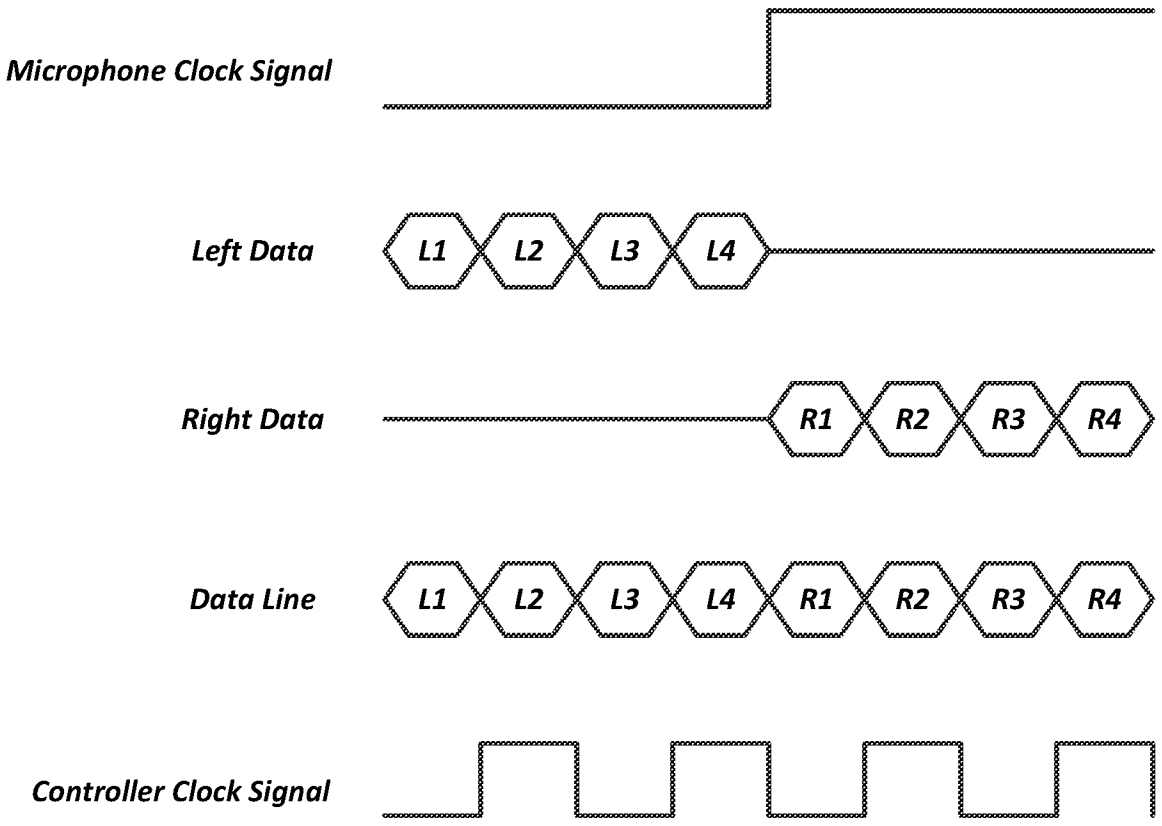
FIG. 5 is a timing diagram illustrating signals generated within a digital interface supporting 8 microphones.

For example, FIG. 5 is a timing diagram illustrating signals generated within a digital interface supporting 8 microphones (i.e., four left microphone and four right microphones). As illustrated in FIG. 5, each microphone clock signal has a clock rate one-fourth the rate of the controller clock signal. The designated parent microphone on the left outputs a combined data signal including data from the three child microphones (i.e., L1, L2, and L3) and its own data (i.e., L4) on one half of a cycle of the microphone clock signal. Similarly, the designated parent microphone on the right outputs a combined data signal including from the three child microphones (i.e., R1, R2, and R3) and its own data (i.e., R4) on an opposite half of the cycle of the microphone clock signal. As also illustrated in FIG. 5, each individual piece of data output by a parent microphone to the codec 20 is transmitted on a different edge of the controller clock signal.

Figure 6:
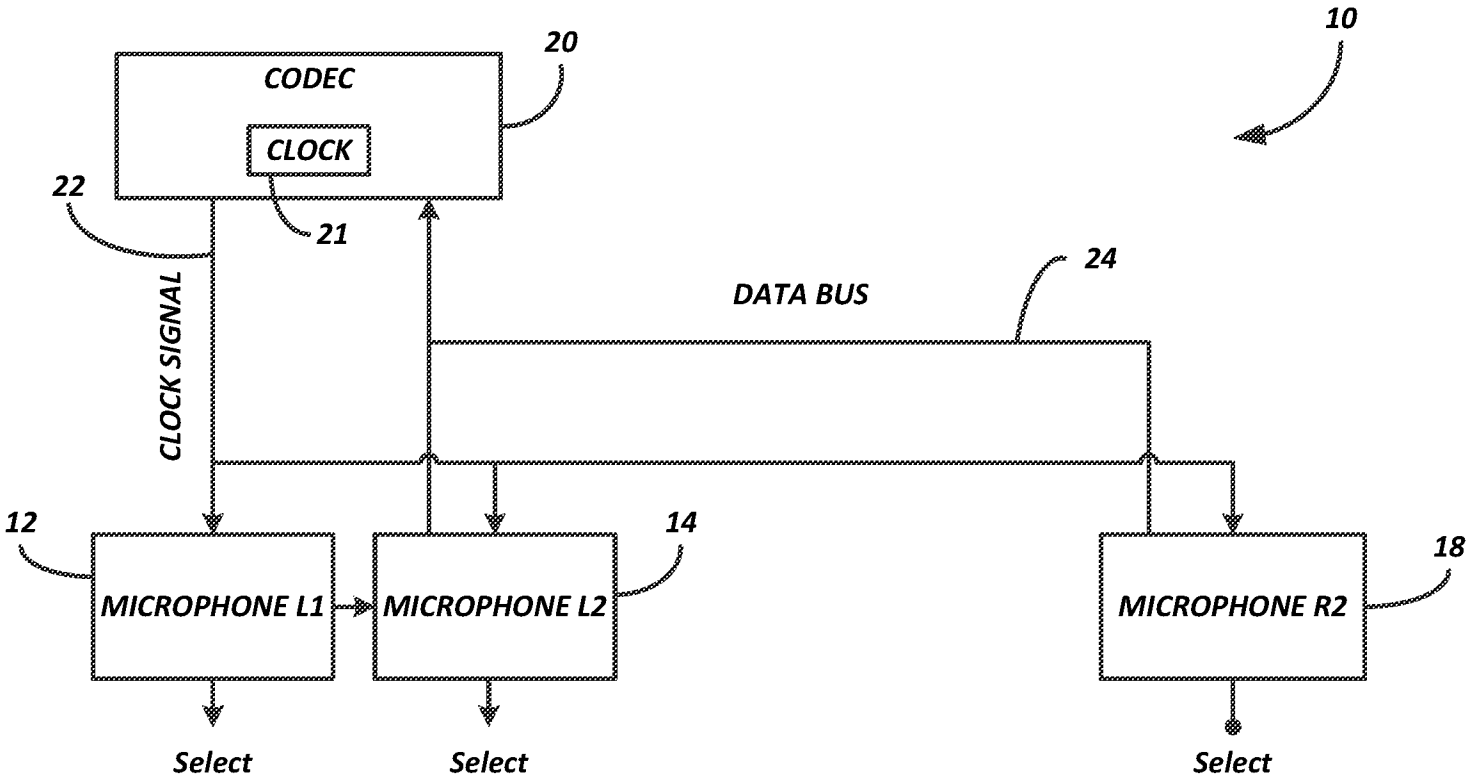
FIG. 6 schematically illustrates a digital interface supporting three microphones.

Furthermore, it should be understood that in some embodiments, a different number of left and right microphones can be used with the interface 10. For example, in some embodiments, two microphones can be used on the left and four microphones can be used on the right. Also, as illustrated in FIG. 6, in some embodiments, only one microphone may be used on one side (i.e., left or right) of the interface. In this configuration, no parent-child configuration is needed on the side including only a single microphone. However, in some embodiments, to maintain the same microphone clock signal among all the microphones, the single microphone (e.g., microphone 18 illustrated in FIG. 6) can be configured to repeat its data over one half of the microphone clock signal (i.e., transmit the same data over a full cycle of the controller clock signal). In other embodiments, the microphone 18 can be configured to transmit a default data signal in place of the missing child microphone (e.g., a null or zero data signal) that informs the codec 20 that only a single microphone is being used on one side of the interface 10. Similarly, the same logic can be used to allow a side of interface 10 to include less than the full $2^N$ microphones (e.g., three, five, six, etc. microphones).

Thus, embodiments of the invention provide methods and systems for allowing three or more microphones to communicate with a codec over a single data line or bus. Accordingly, no pin changes are needed to expand a codec to support additional microphones.

Various features of the invention are set forth in the following claims.

What is claimed is:

1. A microphone interface extension comprising:

a controller outputting a controller clock signal;

a parent microphone receiving the controller clock signal and generating a first data signal; and a child microphone generating a second data signal and outputting the second data signal to the parent microphone;

wherein the parent microphone receives the second data signal from the child microphone and outputs a combined data signal to the controller based on the first data signal and the second data signal, the combined data signal including the first data signal generated by the parent microphone and the second data signal generated by the child microphone, wherein the parent microphone outputs the combined data signal to the controller on a phase of a microphone clock signal derived from the controller clock signal by outputting the first data signal on a first edge of the microphone clock signal and outputting the second data signal on a second edge of the microphone clock signal opposite the first edge, wherein the controller clock signal has a cycle time faster than a cycle time of the microphone clock signal, and wherein the cycle time of the microphone clock signal is based on a number of child microphones connected to the parent microphone.

2. The microphone interface extension of claim 1, wherein the cycle time of the controller clock signal is twice as fast as the cycle time of the microphone clock signal.

3. The microphone interface extension of claim 1, wherein the child microphone includes an output coupled to an input of the parent microphone and outputs the second data signal directly to the parent microphone.

4. The microphone interface extension of claim 1, wherein the second data signal drives an address select input of the parent microphone, the address select input commanding the parent microphone to output the combined data signal to the controller.

5. The microphone interface extension of claim 1, further comprising a third microphone receiving the controller clock signal, generating a third data signal, and outputting the third data signal to the controller on alternating cycles of the controller clock signal.

6. A microphone interface system comprising:

a controller outputting first and second controller clock signals;

a parent microphone receiving the first controller clock signal and generating a first data signal; and a child microphone receiving the second controller clock signal and generating a second data signal;

wherein the child microphone couples to an input of the parent microphone and outputs the second data signal to the parent microphone, wherein the parent microphone receives the second data signal from the child microphone and outputs a combined data signal to the controller based on the first data signal and the second data signal, the combined data signal including the first data signal generated by the parent microphone and the second data signal generated by the child microphone, wherein the parent microphone outputs the combined data signal to the controller on a phase of a microphone clock signal derived from the controller clock signal by outputting the first data signal on a first edge of the microphone clock signal and outputting the second data signal on a second edge of the microphone clock signal opposite the first edge, wherein the controller clock signal has a cycle time faster than a cycle time of the microphone clock signal, and wherein the cycle time of the microphone clock signal is based on a number of child microphones connected to the parent microphone.

7. The microphone interface extension of claim 6, wherein the cycle time of the controller clock signal is twice as fast as the cycle time of the microphone clock signal.

8. The microphone interface extension of claim 6, wherein the child microphone includes an output coupled to the input of the parent microphone and outputs the second data signal directly to the parent microphone.

9. The microphone interface extension of claim 6, wherein the second data signal drives an address select input of the parent microphone, the address select input commanding the parent microphone to output the combined data signal to the controller.

10. The microphone interface extension of claim 6, further comprising a third microphone receiving the controller clock signal, generating a third data signal, and outputting the third data signal to the controller on alternating cycles of the controller clock signal.

11. A method for extending a microphone interface, the method comprising:

receiving, at a first microphone, a controller clock signal from a controller;

generating, by the first microphone, a first data signal;

receiving, at the first microphone, a second data signal from a second microphone; and outputting, by the first microphone a combined data signal to the controller based on the first data signal and the second data signal over a full cycle of the controller clock signal, the combined data signal including the first data signal generated by the parent microphone and the second data signal generated by the child microphone, wherein the first data signal is output on a first edge of a microphone clock signal and the second data signal is output on a second edge of the microphone clock signal, wherein the controller clock signal has a cycle time faster than a cycle time of the microphone clock signal, and wherein the cycle time of the microphone clock signal is based on a number of child microphones connected to the parent microphone.

12. The method of claim 11, further comprising deriving the microphone clock signal from the controller clock signal, wherein the cycle time of the microphone clock signal is twice the cycle time of the controller clock signal.

13. The method of claim 11, further comprising detecting, at the first microphone, a state of an address select pin of the first microphone to automatically determine whether the first microphone outputs the combined data signal to the controller or outputs the first data signal to the second microphone.

* * * * *